US006991441B2

(12) United States Patent
Bahniuk

(10) Patent No.: US 6,991,441 B2
(45) Date of Patent: Jan. 31, 2006

(54) EXPANSIBLE CHAMBER DEVICE HAVING ROTATING PISTON BRAKING AND ROTATING PISTON SYNCHRONIZING SYSTEMS

(76) Inventor: Eugene Bahniuk, 7629 Cairn La., Gates Mills, OH (US) 44040

( * ) Notice: Subject to any disclaimer, the term of this patent is extended or adjusted under 35 U.S.C. 154(b) by 371 days.

(21) Appl. No.: 10/277,642

(22) Filed: Oct. 22, 2002

(65) Prior Publication Data

US 2003/0138337 A1 Jul. 24, 2003

Related U.S. Application Data

(60) Provisional application No. 60/351,024, filed on Jan. 23, 2002.

(51) Int. Cl.
*F01C 1/00* (2006.01)

(52) U.S. Cl. ..... 418/35; 418/33; 123/245

(58) Field of Classification Search ..... 123/245; 418/33, 35

See application file for complete search history.

(56) References Cited

U.S. PATENT DOCUMENTS

| | | | | |
|---|---|---|---|---|
| 1,317,909 | A | | 10/1919 | Deuel |
| 1,596,928 | A | | 8/1926 | Goalen |
| 1,944,875 | A | | 1/1934 | Bullington |
| 3,075,506 | A | | 1/1963 | Berry |
| 3,396,632 | A | | 8/1968 | Leblanc |
| 3,822,971 | A | | 7/1974 | Chahrouri |
| 3,909,162 | A | | 9/1975 | Nutku |
| 4,279,577 | A | | 7/1981 | Appleton |
| 4,359,980 | A | | 11/1982 | Somraty |
| 4,373,879 | A | | 2/1983 | Picavet |
| 4,390,327 | A | | 6/1983 | Picavet |
| 4,605,361 | A | | 8/1986 | Cordray |
| 4,744,736 | A | | 5/1988 | Stauffer |
| 4,890,591 | A | | 1/1990 | Stauffer |
| 5,069,604 | A | | 12/1991 | Al-Sabih |
| 5,083,539 | A | | 1/1992 | Cornelio |
| 5,381,766 | A | | 1/1995 | Sakita |
| 5,400,754 | A | | 3/1995 | Blanco Palacios et al. |
| 5,429,085 | A | | 7/1995 | Stauffer |
| 5,433,179 | A | | 7/1995 | Wittry |
| 5,501,070 | A | * | 3/1996 | Lin ..... 60/39.34 |
| 5,537,973 | A | | 7/1996 | Wittry |
| 5,622,149 | A | | 4/1997 | Wittry |
| 5,727,518 | A | | 3/1998 | Blanco Palacios et al. |
| 6,036,461 | A | * | 3/2000 | Bahniuk ..... 418/35 |

* cited by examiner

*Primary Examiner*—Hai Huynh
(74) *Attorney, Agent, or Firm*—Fay, Sharpe, Fagan, Minnich & McKee, LLP

(57) ABSTRACT

An expansible chamber device includes a braking system with a set of cam surfaces on the piston assemblies and a set of movable members adapted to alternately engage first and second sets of cam surfaces to stop the rotation of first piston assembly while permitting second piston assembly to rotate freely. A pair of elongate pivotable members engage the piston assemblies on one end and engage a slidable member having an adjustable length on the other end. The slidable member and the pivotable members alternate between first and second positions in response to engagement with ramp and stop surfaces provided on the piston assemblies. The rotating piston synchronizing system includes a set of biasing springs to urge the pivotable members into a suitable position to permit the device to be started from an at rest condition. The adjustable length slidable member enables a variable compression ratio.

22 Claims, 16 Drawing Sheets

EXPANSIBLE CHAMBER DEVICE HAVING ROTATING PISTON BRAKING AND ROTATING PISTON SYNCHRONIZING SYSTEMS

CROSS-REFERENCE TO RELATED APPLICATIONS

This application claims the benefit of U.S. Provisional Application Ser. No. 60/351,024, filed Jan. 23, 2002.

BACKGROUND OF THE INVENTION

The present invention is directed to expansible chamber devices and, in particular, to expansible chamber devices in which working members comprise alternately approaching and receiving elements. The invention finds particular application in devices such as alternating piston rotary internal combustion engines, pumps, and fluid motors. One embodiment of the invention relates to braking systems for controlling the motion of the working members in an expansible chamber device, including control of the intermittent rotation of the alternately approaching and receding elements used to define one or more expansible chambers. Another embodiment of the invention relates to a rotating piston synchronizing system for controlling the maximum extent of relative rotational motion between pairs of alternately approaching and receding elements of the expansible chamber device to enable the device to be easily started from an at-rest condition. A still further embodiment relates to a rotating piston synchronizing system for varying the timing of the working members in expansible chamber devices to adjust the compression ratio within the device.

Expansible chamber devices generally operate by changing the volume defined between working members in order to compress a working fluid or gas. One form of known expansible chamber devices, for example, is that disclosed in U.S. Pat. No. 4,279,577. There, the device incorporates a pair of opposed rotating members comprising one or more radially extending vanes or abutments to define, in part, an expansible chamber. Each of these members undergoes intermittent and alternating motion throughout the cyclic operation of the engine or pump. In devices of this type, the movement of the rotating members must be carefully controlled and synchronized. In the past, this control has been accomplished using control mechanisms which are complex in design and operation and which may be unreliable at higher operating speeds.

In U.S. Pat. No. 4,605,361, an oscillating vane rotary pump or motor uses a drive pin adapted to engage helical slots defined in coaxial rotor shafts and cam rollers to provide for oscillating the rotors and vanes with respect to each other as the rotors rotate with respect to the rotary pump or motor cylinder. In that system, a stationary cam is needed to permit the two pistons to rotate continuously as the output, or input in a pump, shaft rotates. Accordingly, that device is of little use in expansible chamber devices of the type including rotating pistons that intermittently rotate in the same direction during recurrent periods of rotation with each of the piston assemblies being stopped between the periods of rotation.

Sets of non-circular gears are used to control the relative positions of the rotating pistons in U.S. Pat. No. 5,381,766. The gears in that system, however, are difficult and expensive to manufacture and, further, do not provide a uniform output on the shaft.

An additional problem in devices of this kind is the inability to provide an adjustable compression ratio. There is a further need to provide an adjustable compression ratio during operation of the device.

A further problem in devices of this type is the difficulty in starting the devices from a stopped or at rest condition. Typically, various mechanisms within the device must be manually oriented into proper position before the output shaft(s) can be rotated in a starting mode of operation.

It would, therefore, be desirable to provide a device for controlling the motion of the working members in an efficient and simple fashion which solves the problems recognized in the prior art. It would further be desirable to provide a device for controlling the relative angular position between the working members to be constrained within a limited predetermined range for purposes of synchronizing them at start up when the expansible chamber device is used as an engine. It would additionally be desirable to provide a device for controllably adjusting the relative angular position between the working members to provide a variable compression ratio. Preferably, the compression ratio is adjustable either at a stop or while the device is functioning.

The aforementioned problems and others are addressed by the present invention described in detail in this specification.

SUMMARY OF THE INVENTION

The subject invention provides improvements to expansible chamber devices of the type described which controls the motion of the working members for intermittent motion of alternately approaching and receding elements and which synchronizes the working members so that the maximum extent of relative rotational movement is constrained to within a predetermined extent. In addition, the invention provides other improvements resulting in significant operating efficiencies and also enabling the expansible chamber device to be used in a wide variety of applications. Furthermore the invention provides means for adjusting the compression ratio within the device, either while the device is in operation of when it is stopped.

In accordance with one embodiment of the subject invention, there is provided an internal combustion engine that includes a housing defining a cylindrical working chamber and first and second interdigitated piston assemblies rotatably moveable in the cylindrical working chamber. The housing includes intake and exhaust ports and each piston assembly includes at least one pair of diametrically opposed radial vanes forming pistons in the working chamber. The pistons divide the working chamber into a plurality of pairs of diametrically opposed compartments. A braking mechanism controls the motion of the piston assemblies to cause intermittent rotation of the first and second piston assemblies in the same direction during current periods of rotation with each the first and second piston assemblies being stopped between the periods of rotation. The braking mechanism includes a first and second set of cam surfaces formed on the first and second piston assemblies respectively. A set of moveable members are adapted to alternately engage the first set of cam surfaces to stop the rotation of the first piston assembly while permitting the second piston assembly to rotate freely and then to engage the second set of cam surfaces to stop the rotation of the second piston assembly while permitting the first piston assembly to rotate freely.

In accordance with a further aspect of the invention, the braking mechanism includes first and second elongate pivotable members having first ends adapted to engage the first and second set of cam surfaces, respectively. A slidable member is disposed between second ends of the first and second elongate pivotable members for transmitting motion there-between. In their preferred form, the first and second set of cam surfaces each include a pair of ramp surfaces and a pair of stop blocks. The first pair of stop blocks are adapted to engage the first pivotable member and stop the rotation of the first piston assembly when the first pivotable member is in a first position. The second pair of stop blocks are adapted to engage the second pivotable member and stop the rotation of the second piston assembly when the second pivotable member is in a first position.

The first elongate pivotable members are adapted to ensure engagement of the first set of stop blocks via constricting means while enabling the second elongate piovatable member to move freely in the first position via constricting means. A second set of constricting means is used to enable the first pivotable member to move freely while the send pivotable member engages the second set of stop blocks in the second position.

The first and second pair of ramp surfaces on the first and second piston assemblies, respectively, are adapted to engage the first and second pivotable members to alternately urge the pivotable members between first and second positions to enable the first and second piston assemblies to be stopped between periods of rotation.

In one preferred form of the slidable member, first and second rod members are disposed between the pivotable members and the first and second rod members are connected together by an intermediate dampening spring member to permit relative slidable motion between the rod members so that the braking mechanism operates smoothly and to enable the device to be started from a stopped condition without manual intervention.

In accordance with yet another aspect of the subject invention, the slidable member is adjustable in length to allow for adjustment of the compression ratio within the device. In one preferred form of the slidable member, first and second rod members are connected via a hydromechanical device allowing for adjustment of the length of the slidable member while the subject invention is in operation. At the leading end of each rod member a piston and a seal are located. Each piston and seal is encased in a bore, and connected by an extension spring, pulling the pistons close together.

In one preferred form the hydromechanical device consists of a bore, a first conduit, a second conduit, and two venting areas, said venting areas being disposed at the trailing edge of the first and second piston within the bore, a first conduit section leading into the bore, a second conduit section, and a flow restrictor connecting the first and second conduit sections. Pressure within the bore is controlled by regulation of the pressure within the second conduit and the flow restrictor. When the pressure within the bore is changed, force is exerted against the two pistons until the spring force is overcome, causing the pistons to move in opposite directions, increasing the overall length of the slidable member, thus reducing the compression ration within the device.

In accordance with yet a further aspect of the subject invention, an internal combustion engine of the type described is provided including an elongate output shaft connected to the first and second piston assembly and defining a set of connection areas arranged on the output shaft to extend in directions transverse to the longitudinal axis of the shaft. A set of link elements are provided for engagement with the set of connection areas. Each link element is simultaneously slidably engagable with both of the first and second piston assemblies to transmit rotational motion from the first and second piston assemblies to the output shaft and to permit relative rotation between the first and second piston assemblies about the longitudinal axis of the output shaft within a predetermined range. Synchronization between the first and second piston assemblies are thereby provided.

In their preferred form, the set of connection areas include a pair of connection axle members extending in substantially diametrically opposite directions from the output shaft substantially perpendicular to the longitudinal axis defined by the shaft. The set of link elements preferably include the first and second link members that are rotatably carried on the pair of connection axle members. The first group of link areas include first and second link pins carried on the first and second connection axle members respectively. The first and second link pins are adapted for slidable movement in arcuate grooves provided in the first piston assembly. Similarly, the second group of link areas include third and fourth link pins carried on the first and second connection axle members respectively. The third and fourth link pins are adapted for slidable movement in an arcuate groove provided in the second piston assembly.

In its preferred form, the synchronizing mechanism permits relative rotation between the first and second piston assemblies about the longitudinal axis of the output shaft within a predetermined range of about 0–70 degrees when each piston assembly carries four radial pistons, about 0–150 degrees when each piston assembly carries two radial pistons, and about 0–330 degrees when each piston assembly carries a single radial piston.

In view of the above, it is an object of the invention to provide an improved mechanism for controlling the motion of the piston assemblies in an expansible chamber device to cause intermittent rotation of the piston assemblies in the same direction during recurrent periods of rotation with each of the first and second piston assemblies being stopped between periods of rotation.

A further object of the invention is the provision of a synchronizing mechanism for use in expansible chamber devices of the type described to limit relative rotation between pairs of piston assemblies to within a predetermined range to permit the device to be started from an at rest condition without manual intervention.

An even further objective of the invention is the provision of an synchronizing mechanism which allows for the adjustment of the compression ratio within the device both while the device is operating and when it is at rest.

Still other advantages and benefits of the invention will become apparent to those skilled in the art upon a reading and understanding of the following detailed description.

BRIEF DESCRIPTION OF THE DRAWINGS

The invention may take physical form in certain parts and arrangement of parts, the preferred embodiments of which will be described in detail in this specification and illustrated in the accompanying drawings which form a part hereof, and wherein.

DETAILED DESCRIPTION OF THE PREFERRED EMBODIMENTS

Figure 1:
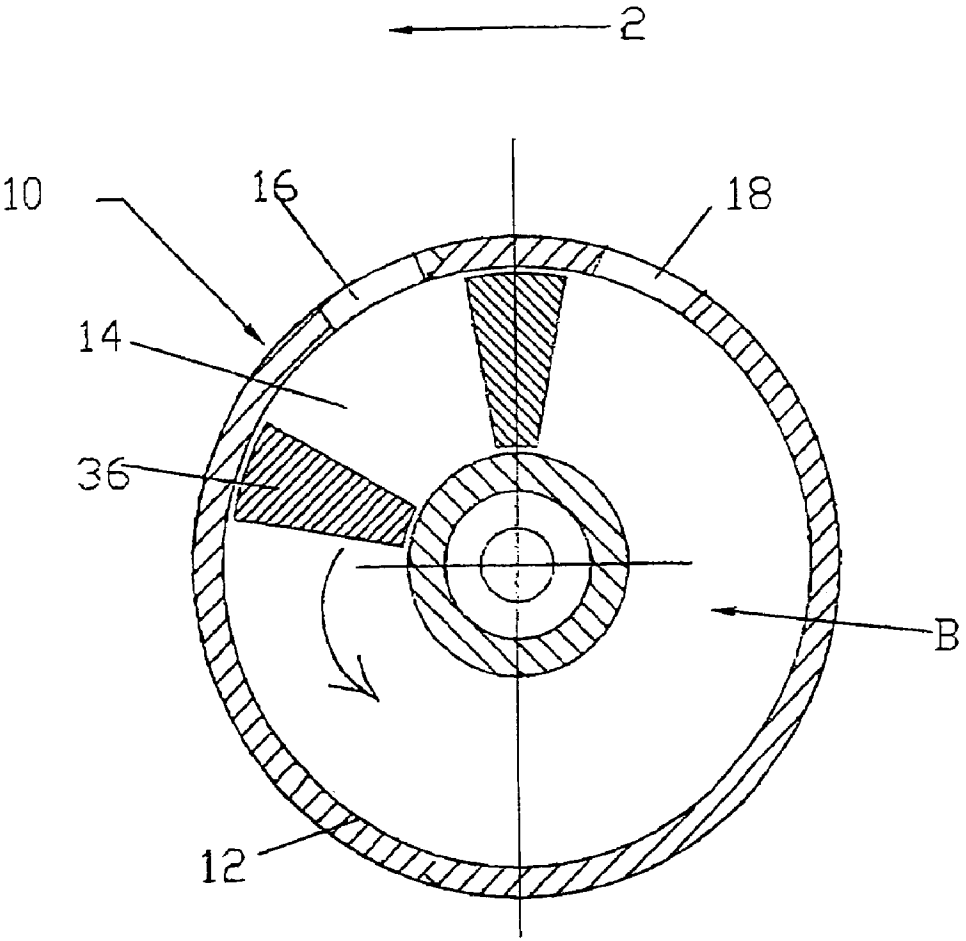
FIG. 1 is an end view taken in partial cross-section showing the overall arrangement of an expansible chamber device of the type to which the invention is directed.
Figure 2:
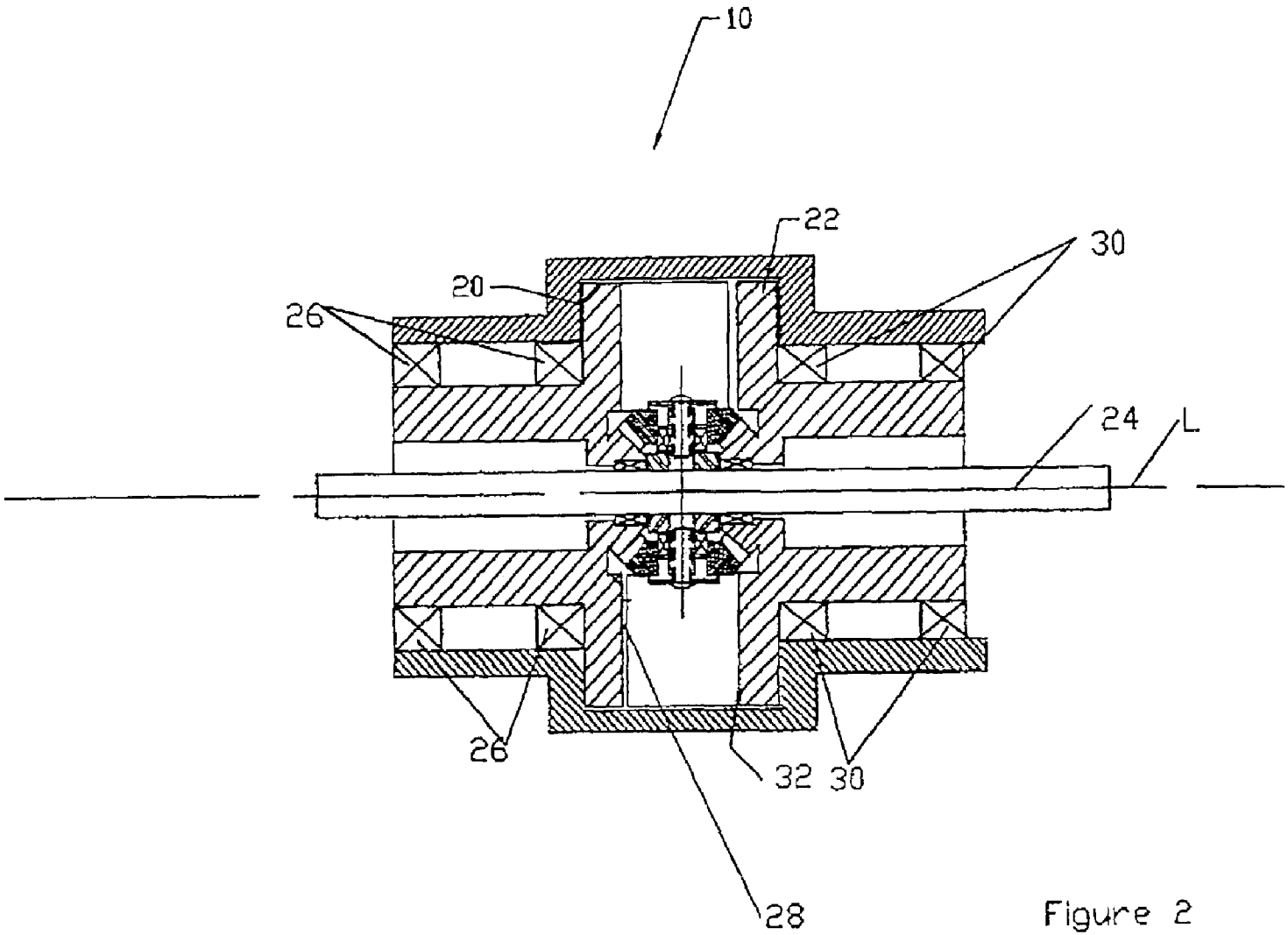
FIG. 2 is a side view taken in partial cross-section along line 2—2 of FIG. 1.

Referring now to the drawings wherein the showings are for the purposes of illustrating the preferred embodiments of the invention only and not for purposes of limiting the same, FIGS. 1 and 2 show the overall arrangement of an expansible chamber device of the type to which the embodiments of the invention are directed. In the system illustrated, the expansible chamber device 10 includes a housing 12 defining a cylindrical working chamber 14 having an inlet port 16 and an outlet port 18. First and second interdigitated piston assemblies 20, 22 are rotatably movable in the cylindrical working chamber 14. As is shown, the first piston assembly 20 is carried on an elongate shaft 24 that is constrained by a set of support bearings 26 to rotate about a longitudinal axis L. Connected to the shaft 24 is a first side plate member 28 which forms one side of the cylindrical working chamber 14. Similarly, the second piston assembly 22 is carried on the shaft 24 by a second set of support bearings 30 arranged as shown. A second side plate 32 forms the other side of the cylindrical working chamber 14.

Each of the first and second piston assemblies 20, 22 include at least one radially extended vane 34, 36, respectively, forming pistons in the working chamber and dividing the working chamber into pairs diametrically opposed compartments or volumes A, B, respectively. The housing member 12 forms the outer circular extent of the volumes A, B and the piston assemblies carry a centerpiece 38 which forms the inner wall of the volume A, B.

In operation, the first and second piston assemblies 20, 22 both rotate about the same longitudinal axis L. The two groups of piston assemblies rotate with relative velocities with respect to one another. When the rotational velocities of the first and second piston assemblies are different, the volumes A, B change in size in a manner such that when one volume is increasing in size, the diametrically opposed volume of the pair is, necessarily, decreasing in size. In most expansible chamber devices of the type described, the piston assemblies rotate in the same direction during recurrent periods of rotation with each of the piston assemblies being stopped between periods of rotation. Although the piston assemblies can move either in a clockwise or counter clockwise direction in a given application, they are constrained to rotate in one direction.

With continued reference to FIGS. 1 and 2, but with particular attention to FIG. 1, the volumes A, B expand and contract as the pistons 34, 36 alternately rotate. When the first piston 34 is stationary and the second position 36 is rotating in the counter clockwise direction as indicated by the arrow labeled R in the figure, the first volume A increases in size while the second volume B decreases in size. The second piston 36 moves away from the first piston 34 to draw fluid into the increasing volume A through the inlet port 16. The second piston 36 is also moving toward the first piston 34 as to the second volume B to expel fluid through the outlet port 18. Accordingly, the expansible chamber device 10 illustrated in the figures are capable of performing the basic functions of simultaneous increasing and decreasing volumes.

A braking mechanism for controlling the motion of the piston assemblies to cause intermittent rotation of the first and second pistons in the same direction during recurrent periods of rotation will be described below. Another important aspect to realize the above functionality but not shown in the basic drawings of FIGS. 1 and 2 is a mechanism or device which prevents rotation in the opposite direction of the piston assemblies. In FIG. 1, such device would prevent rotation of the piston assemblies in the clockwise direction. One such mechanism that could be used to perform this function is a "sprag" clutch. Sprag clutches in other anti-rotation mechanisms or devices are not needed in pumps but are necessary in motors and internal combustion engines.

With yet continued reference to FIGS. 1 and 2, as the second rotating piston 36 rotates about the longitudinal axis L, it approaches the stationary piston 34. The braking mechanism described in detail below provides for a release of the stationary piston 34 at the appropriate time, and further, provides for the braking of the motion of the moving piston 36 at the appropriate time and position. During the next period of operation, the second piston 36 is stopped in the position previously occupied by the first piston 34. The first piston then moves about the longitudinal axis L. This continues until the first piston 34 approaches the then stationary second piston 36. As the first piston 34 approaches the second piston 36, the second piston is released to move and the first piston 34 then again assumes the position illustrated in FIG. 1. Thus, the pistons are alternately stopped and rotated intermittently during recurrent periods.

As shown in the figures, the expansible chamber device includes multiple pairs of interdigitated pistons that move independently about a common central longitudinal axis in the same direction, either clockwise or counter clockwise. The piston pairs alternately stop and rotate. The piston that is stopped generally absorbs the bulk of the reaction forces generated within the contained volumes of the device. The moving piston transmits the action of the forces generated within the volumes. The action of the forces manifests itself as a torque and or rotation of the output shaft 24 about the longitudinal axis L. A braking mechanism is used to locate the position of the pistons or piston pairs in a manner that while one piston is stopped the other piston is free to move in the predetermined designated direction. An anti-reversing mechanism prevents the pistons from rotating in a direction opposite from the predetermined designated direction when the expansible chamber device is not used as a pumping mechanism. The braking mechanism further allows the stationary piston to move from the stopped position into the designated direction while then stopping the previously moving piston. Lastly, a synchronizing mechanism is provided for limiting the relative angular displacement between the first and second pistons so that the expansible chamber device does not fall out of synchronization preventing the device from being started when used as an engine.

The expansible chamber device of the present invention is useful in many ways to produce mechanical energy from chemical, thermodynamical and various other actions such as when used as an internal combustion engine and also to produce fluid flow or compression in response to a mechanical energy input when the device is used as a pump or compressor.

With still yet continued reference to FIGS. 1 and 2, the motion of the pistons 34, 36 can be caused by either the rotation of the input shaft 24 such as when the device is used as a pump or compressor, or by pressures within the volumes A, B such as when the device is used as an engine or motor.

When the motions of the radial pistons are caused by pressure differentials across the piston faces, the pressure difference can be produced by chemical or thermodynamical actions within the material occupying the volumes A, B or by the flow of material into and out of the compartments defining the volumes A, B. When the subject expansible chamber device is used as a motor, the pressure in volume A is greater than the pressure in volume B causing the second piston to move in the counter clockwise direction as indicated by the arrow R.

Inlet and outlet ports 16, 18 are provided as illustrated in FIG. 1 through the housing for communication of fluid into volume A and out of volume B, respectively. The inlet port 16 is used to introduce flowing materials such as, for example, a fuel mixture, into the first volume A from an external source. The outlet port 18 permits material such as exhaust gases or the like to exit the second volume B. When the first volume A is connected to an external source of a compressed fluid such as when the device is used as a fluid motor, the second piston 36 is urged into counter clockwise rotation as shown in the drawing figure by the arrow labeled R. During movement of the second piston, the first piston 34 is held fixed in place as illustrated by the braking mechanism to be described in detail below. As the second piston rotates, mass flow of material is permitted to escape the second volume B through the outlet port 18. Alternatively, the material in the second volume can be permitted to merely compress within the second volume when the material is compressible.

During operation of the subject expansible chamber device, the second piston 36 continues its counter clockwise rotation until the second volume B is either reduced to near zero or until the face of the second piston closes the outlet port 18. At that time, the second volume B is substantially reduced to near zero and the second piston approaches close to the first piston 34. The braking mechanism is actuated at this point so that the first piston 34 may be released and allowed to move in a counter clockwise rotation. The first piston is urged into motion by either impact with the second piston or, by the pressure generated by the compressed material between the first and second pistons in the second volume B.

As the first piston 34 is permitted to rotate counter clockwise, it advances beyond the inlet port 16 to permit fluid to enter behind the advancing first piston and into the second volume B, the second piston 36 being stopped at the rotational position formerly occupied by the first piston by the action of the locking mechanism described below. The moving pistons cause the output shaft 24 to rotate about the longitudinal axis L to produce torque.

The expansible chamber device of FIGS. 1 and 2 can also act as a pump mechanism when the pistons are back driven through the shaft 24 by an external source of mechanical torque. The moving pistons act on the fluids in the volumes A, B creating vacuum and reduced pressure zones so that fluid enters into the inlet port 16 and exits out of the outlet port 18 at an elevated pressure. When the device is used as a pump, the advancing second piston 36 shown in FIG. 1 is driven by the external source of mechanical torque so as to in effect compress and force the fluid out of the second volume B and through the outlet port 18. In order to be effective, the pump must be connected to an external source of power that can overcome the fluid pressure forces generated in the second volume space B created when the second piston 36 is advanced.

Lastly in connection with the two piston expansible chamber device shown in FIGS. 1 and 2, it should be noted that in some applications the fluids are never depleted or replenished from the first and second volumes A, B and no exchange of fluid flow into or out of the system occurs. In this case, the inlet and outlet ports 16, 18 are completely blocked. For certain chemical or thermodynamic actions, the materials contained within the volumes are alternately expanding and contracting in response to those actions. Loss of the materials out of the device is prevented by closing the inlet and outlet ports. One example of where such a process would be useful in the subject expansible chamber device is when the device is used for a Sterling or similar engines.

Figure 3:
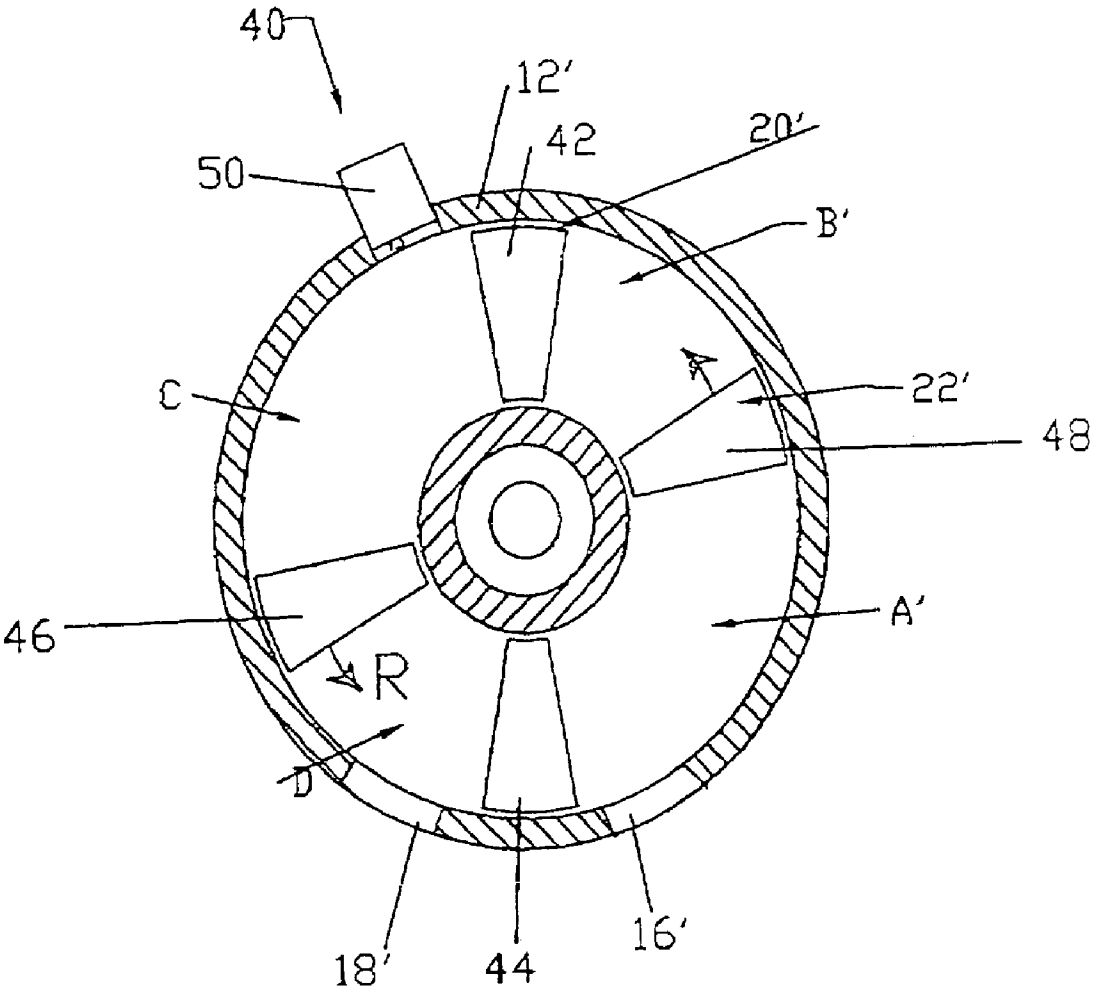
FIG. 3 is an end view taken in partial cross-section showing the overall arrangement of another expansible chamber device of the type to which the invention is directed.

FIG. 3 illustrates the subject expansible chamber device used as a 4-cycle internal combustion engine 40. Turning now to that figure, first and second interdigitated piston assemblies 20', 22' are rotatably movable in a cylindrical working chamber 14' defined by a circular housing member 12'. The first piston assembly includes a pair of diametrically opposed radial vanes forming pistons 42, 44. Similarly, the second piston assembly 22' carries a pair of diametrically opposed radial vanes forming third and fourth pistons 46, 48 in the working chamber.

Also illustrated in FIG. 3, the engine 40 includes an ignition device 50, preferably a spark plug, and intake and exhaust ports 16', 18'. The first and second pistons 42, 44 are part of the first piston assembly 20', and accordingly, rotate together as a unit in a counter clockwise direction as shown. Similarly, the third and fourth pistons 46, 48 form a part of the second piston assembly 22' and, accordingly, rotate together as a unit in the same counter clockwise direction as shown in the drawing by the arrows labeled R. Side plates and shafts are used in the engine in a manner described above in connection with the device of FIGS. 1 and 2. In the piston positions illustrated in FIG. 3, the first and second pistons are stationary and the third and fourth pistons advancing. For operation as an internal combustion engine, a flammable mixture is introduced into the engine through an intake port 16' which is connected to a carburetor, fuel injector, or similar device. The fuel mixture flows into the first volume A' which is expanding as the fourth piston 48 rotates in the counter clockwise direction shown. The second volume B' contains a flammable fuel mixture that was introduced therein during a previous machine cycle.

The fuel mixture in the volume B' is being compressed in the cycle shown in FIG. 3 because the motion of the fourth piston 48 is counter clockwise with respect to the position of the stationary first piston 42. The reduction in size of the volume B' results in a compression of the flammable fuel mixture in the volume B'. When the third and fourth pistons 46, 48 are advanced sufficiently close to the first and second pistons 42, 44, the first piston assembly is released to permit counter clockwise rotation thereof. The second piston assembly is locked into the position illustrated in FIG. 3 previously occupied by the first piston assembly. As the first piston assembly moves counter clockwise, the compressed flammable fuel mixture in the volume B' is exposed to the ignition device 50. An electronic circuit senses the relative position of the first piston assembly and ignites the spark plug causing the fuel in the volume B' to ignite advancing the first piston further in the counter clockwise direction.

The volume C shown in FIG. 3 preferably contains ignited and expanding flammable fuel. The expanding fuel mixture in the third volume C causes the third piston 46 to advance in the counter clockwise rotation as shown. The motion of the third piston in the direction shown correspondingly urges the fourth piston to move because they are connected as described above.

The fourth volume D shown in FIG. 3 contains burned residue left behind from a previous ignition cycle. The motion of the third piston 46 in the counter clockwise direction towards the second piston 44 causes the material in the fourth volume D to be compressed and vent from the chamber 14' through the outlet port 18'.

Figure 4:
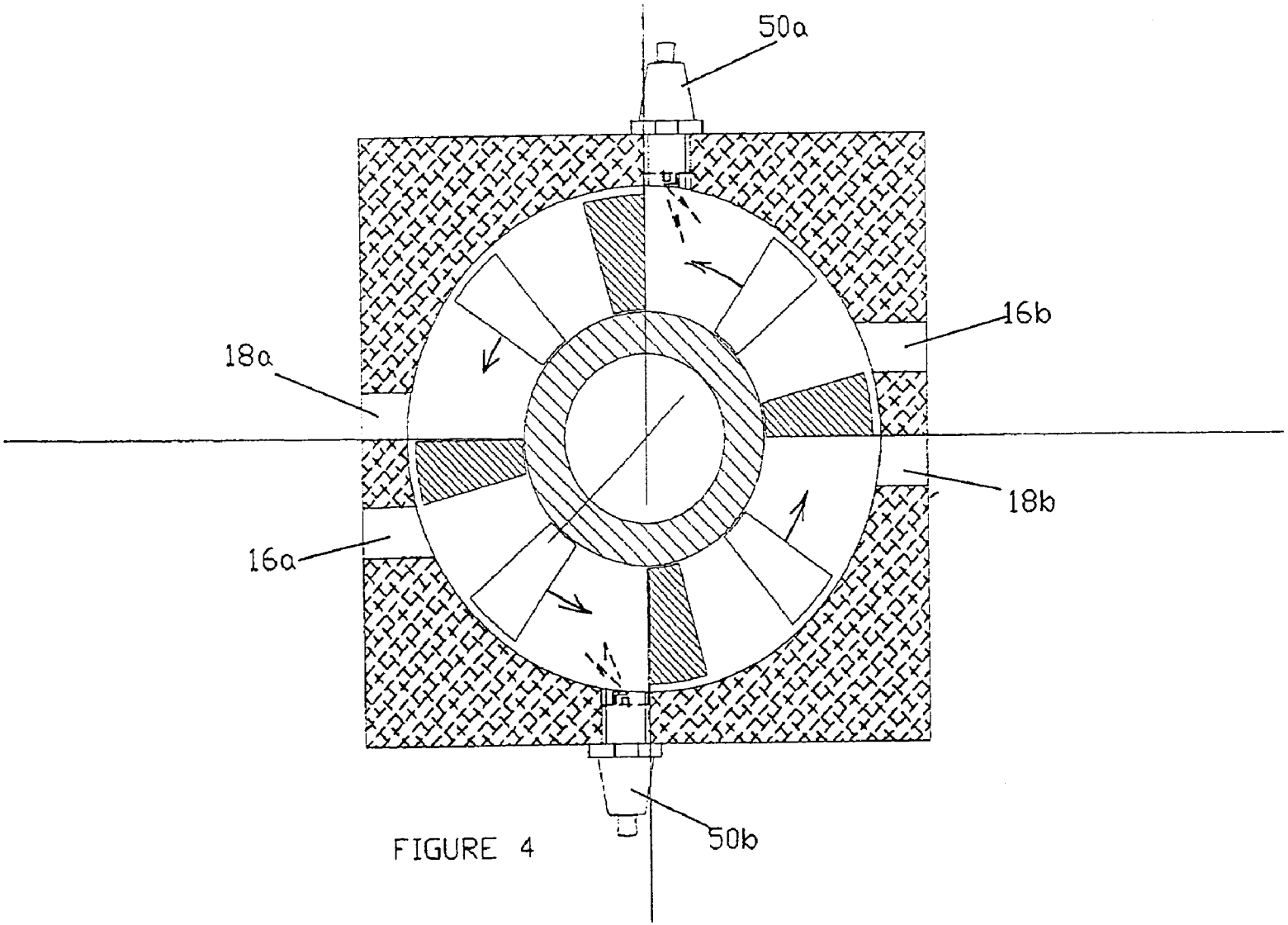
FIG. 4 is an end view taken in partial cross-section of an expansible chamber device of the type that includes a pair of spark plugs.
Figure 5:
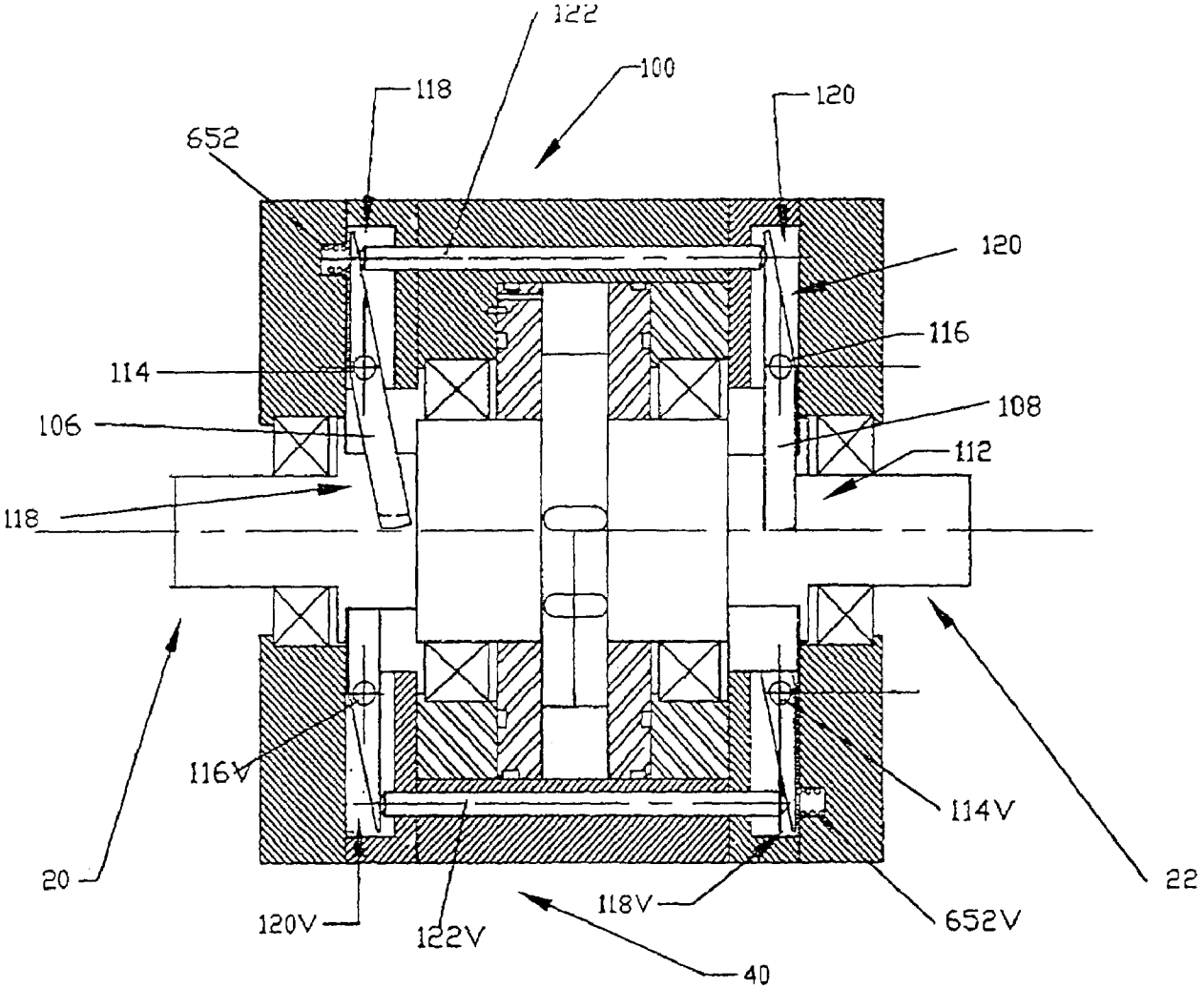
FIG. 5 is a side view taken in partial cross-section showing the subject braking system of the present invention adapted for use in an expansible chamber device.

FIG. 4 shows 4-cycle internal combustion engine formed in accordance with an embodiment of the invention and having four pairs of pistons. A pair of ignition devices 50*a*, 50*b* are provided along with a pair of intake ports 16*a*, 16*b* and a pair of exhaust ports 18*a*, 18*b*. One significant advantage of the construction shown in FIG. 4 is that all of the pressure loads developed within the engine are well balanced. Accordingly, the bearing loads are substantially reduced and wear thereon decreased. In order to strike the preferred load balance, even pairs of pistons are provided. That is, four pistons per piston assembly, and so on.

As noted above, a braking and compression ratio control mechanism is used for stopping the moving pistons in the desired position and holding them there stationary between periods of rotation to cause intermittent rotation of piston assembly pairs. Although the braking and compression control functions can be accomplished in several ways including electro-mechanical, hydraulic, mechanical, or any combination thereof, the preferred braking mechanism of the instant invention is illustrated in FIGS. 5 and 6*a*–6*g*.

Referring now to those figures, the preferred braking mechanism 100 is shown used in conjunction with a4-cycle internal combustion engine 40 of the type described above. A housing 12 defines a cylindrical working chamber 14 having intake and exhaust ports 16, 18. First and second interdigitated piston assemblies 20, 22 are rotatably movable in the cylindrical working chamber. Each of the piston assemblies include at least one pair of diametrically opposed radial vanes forming pistons in the working chamber. In the internal combustion engine illustrated, the first piston assembly 20 carries first and second pistons 42, 44. Similarly, the second piston assembly 22 carries third and fourth radially extending third and fourth pistons 46, 48. The pistons divide the working chamber into a plurality of pairs of diametrically opposed compartments.

The preferred control mechanism 100 formed in accordance with an embodiment of the present invention controls the motion of the piston assemblies to cause intermittent rotation of the first and second piston assemblies in the same direction during the current periods of rotation with each of the first and second piston assemblies being stopped between the periods of rotation. The braking mechanism includes a first set of cam surfaces 102 disposed on the first piston assembly 20 as best shown in FIGS. 6*a*–6*g*. A second set of cam surfaces 104 are similarly disposed on the second piston assembly 22 as shown in those figures. First, second, third, and fourth elongate pivotable members 106, 108V, 108, 106V include first ends 110, 112V, 112, 110V adapted to engage the first and second set of cam surfaces 102, 104, respectively. Further, each of the first and second elongate pivotable members 106, 108V, 108, 106V are rotatable about first and second rotation points 114, 116V, 116, 114V, respectively. The second ends 118, 120V, 120, 118V of the first and second elongate pivotable members 106, 108V 108, 106V adapted to engage an elongate slidable member 122, 122V so that motion of a one or the other of the elongate pivotable members causes a corresponding motion in the other of the elongate pivotable members, preferably in the motion sequence illustrated in FIGS. 6*a*–6*g*. Springs 652, 652V are placed to urge elongate pivotal members 106, 106V, respectively to engage stop blocks 144 or 146 and 152 or 154, respectively. This biases the pivotal members into a suitable position to enable the device to be started from an at rest condition without the need for manual intervention. The operational sequencing of the braking mechanism 100 of the present invention will be described in detail with reference to those figures together with Table I below.

The slidable members 122, 122V are preferably oriented within the internal combustion engine 40 in a manner that its longitudinal axis S is parallel to the longitudinal axis L defined by the first and second rotatable piston assemblies 20, 22. Although the slidable members 122, 122V are fixed in length in FIG. 5, it is to be appreciated that they can be of selectable and/or variable length to control the compression ratio of the device in a manner described below in greater detail. Lines connecting the first, second, third, and fourth rotation points 114, 116, 116V, 114, respectively are preferably parallel to the longitudinal axis L of the piston assemblies to ensure that the motion between the numbers 106, 108, 106V, 108V are 1:1.

With reference once again to FIG. 5 and continued reference to FIGS. 6*a*–6*g*, the first set of cam surfaces 102 preferably includes a first pair of ramp surfaces 140, 142 and a first pair of stop blocks 144, 146 arranged on the first piston assembly 20 as shown. Similarly, the second set of cam surfaces 104 includes a second pair of ramp surfaces 148, 150 and a second pair of stop blocks 152, 154 carried on the second piston assembly 22 as shown.

Figure 6A:
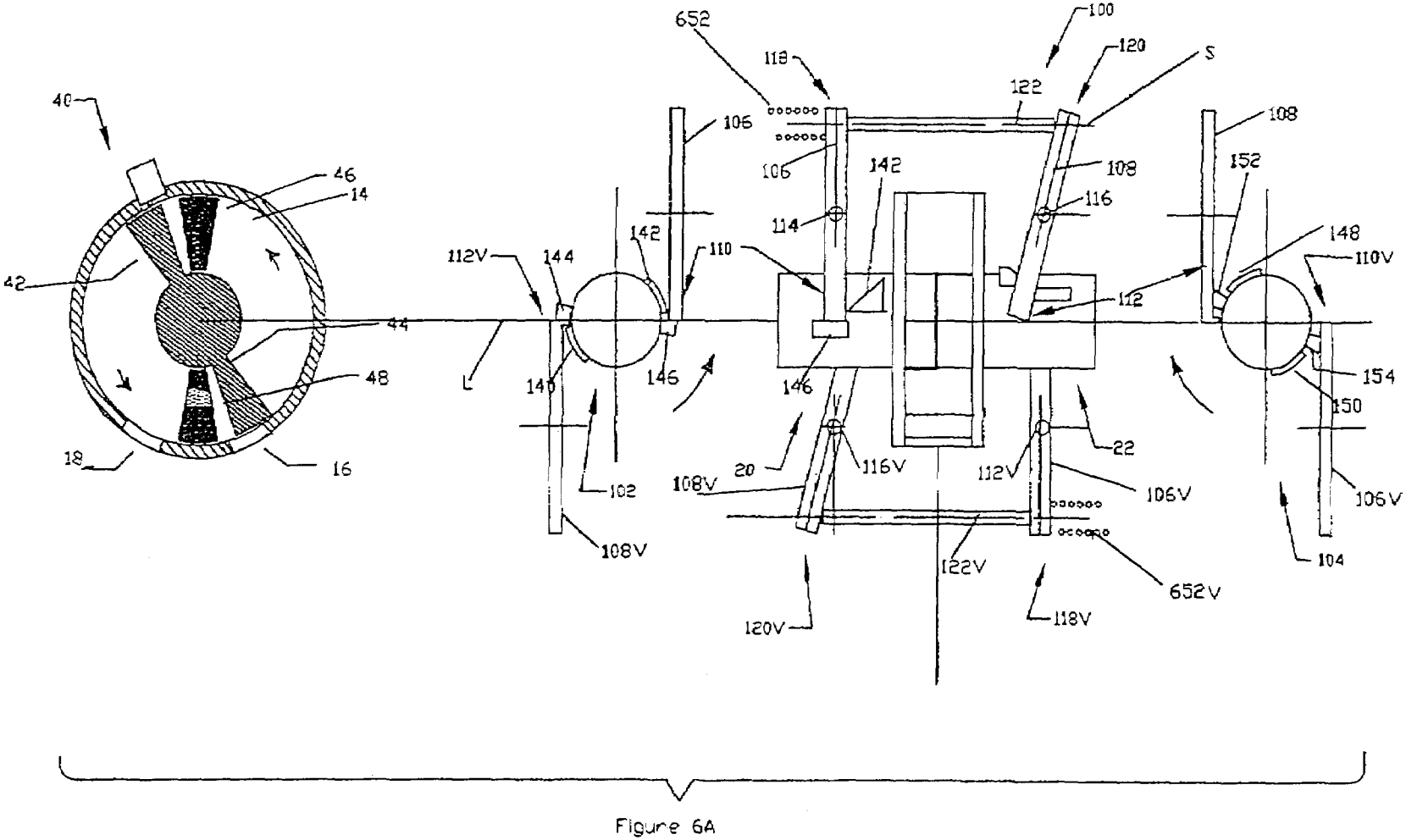
FIGS. 6*a*–6*g* are a series of end views taken in partial cross-section illustrating the sequence of operating the preferred braking mechanism formed in accordance with the present invention.
Figure 6B:
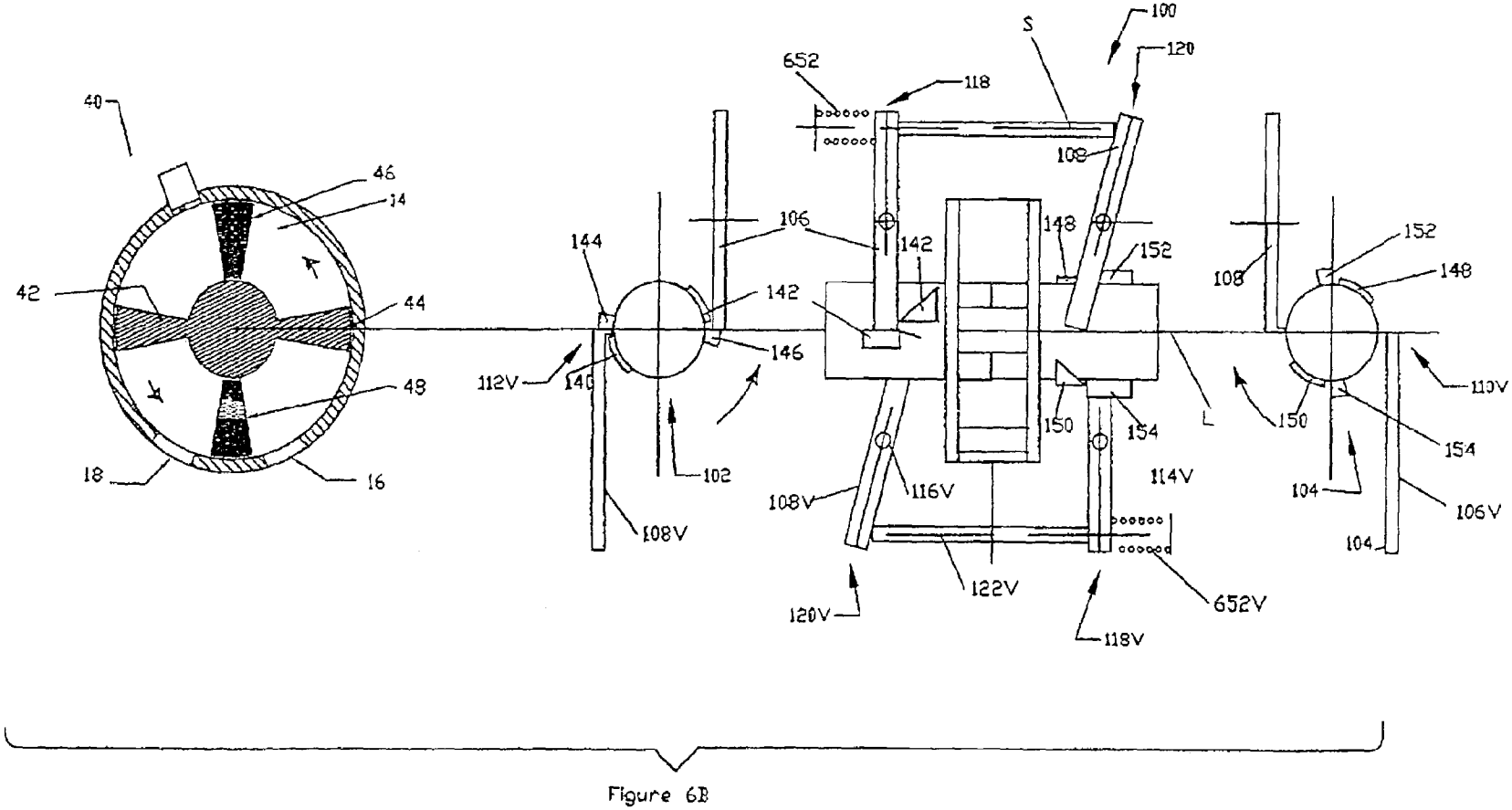
Figure 6C:
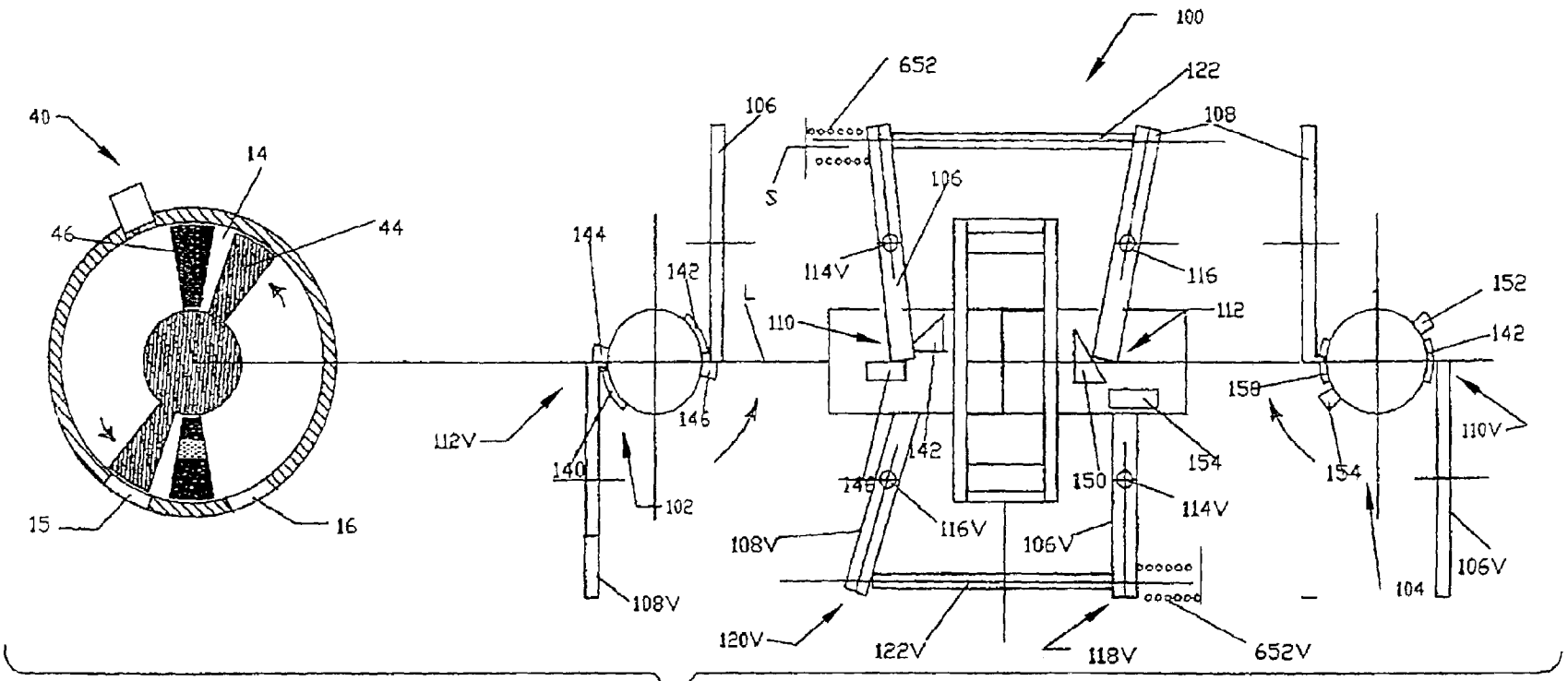
Figure 6D:
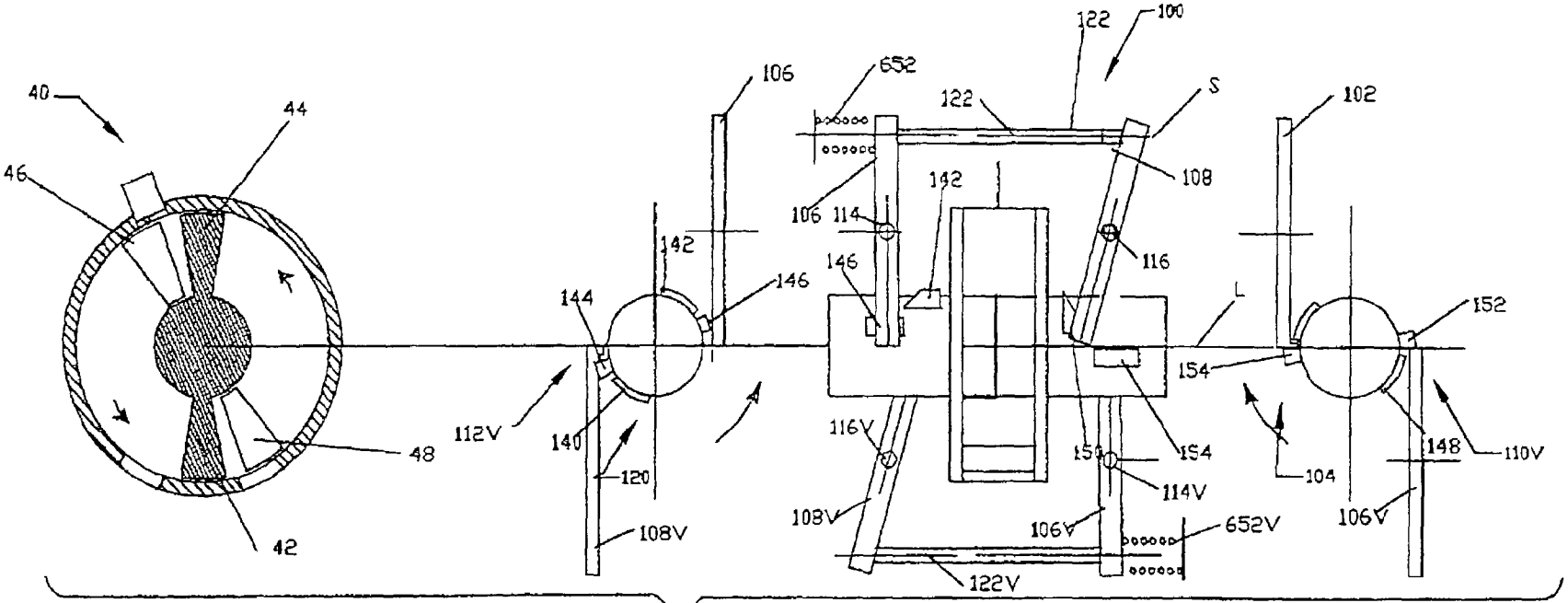
Figure 6E:
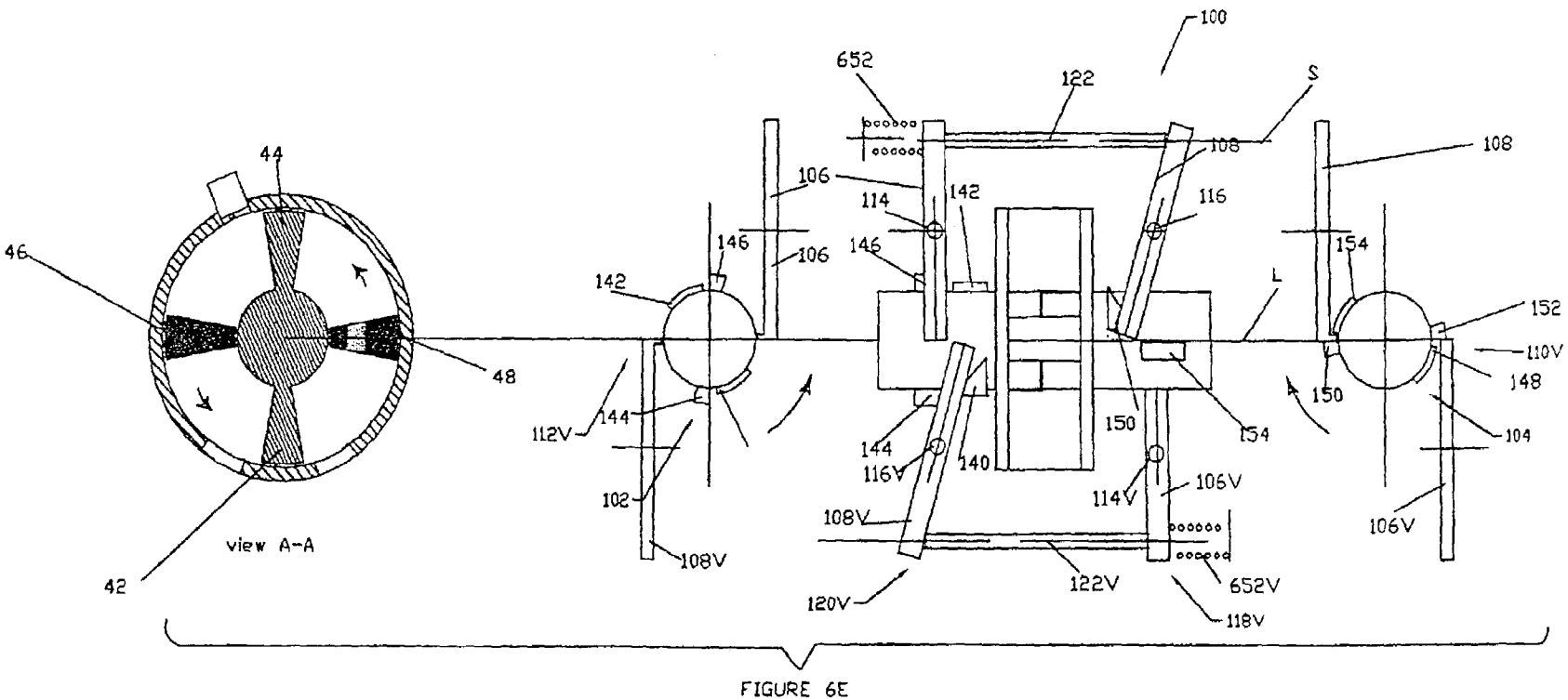
Figure 6F:
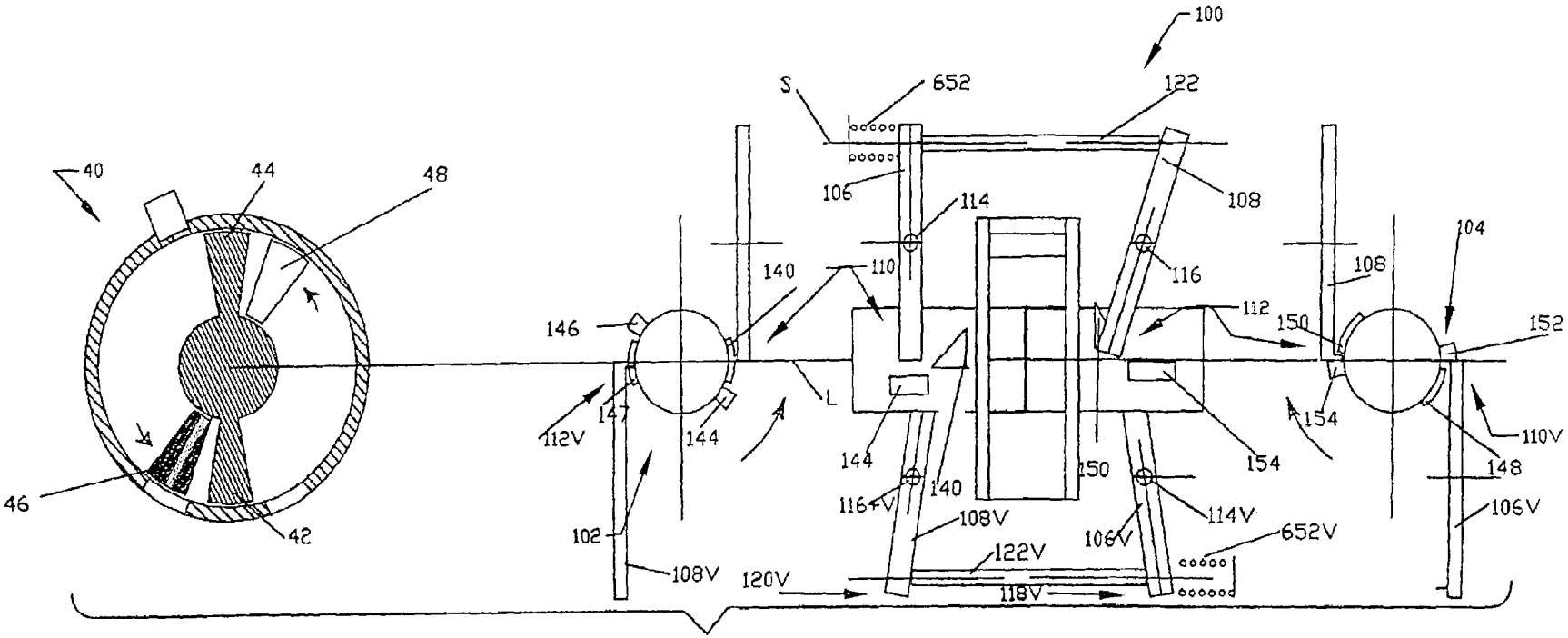
Figure 6G:
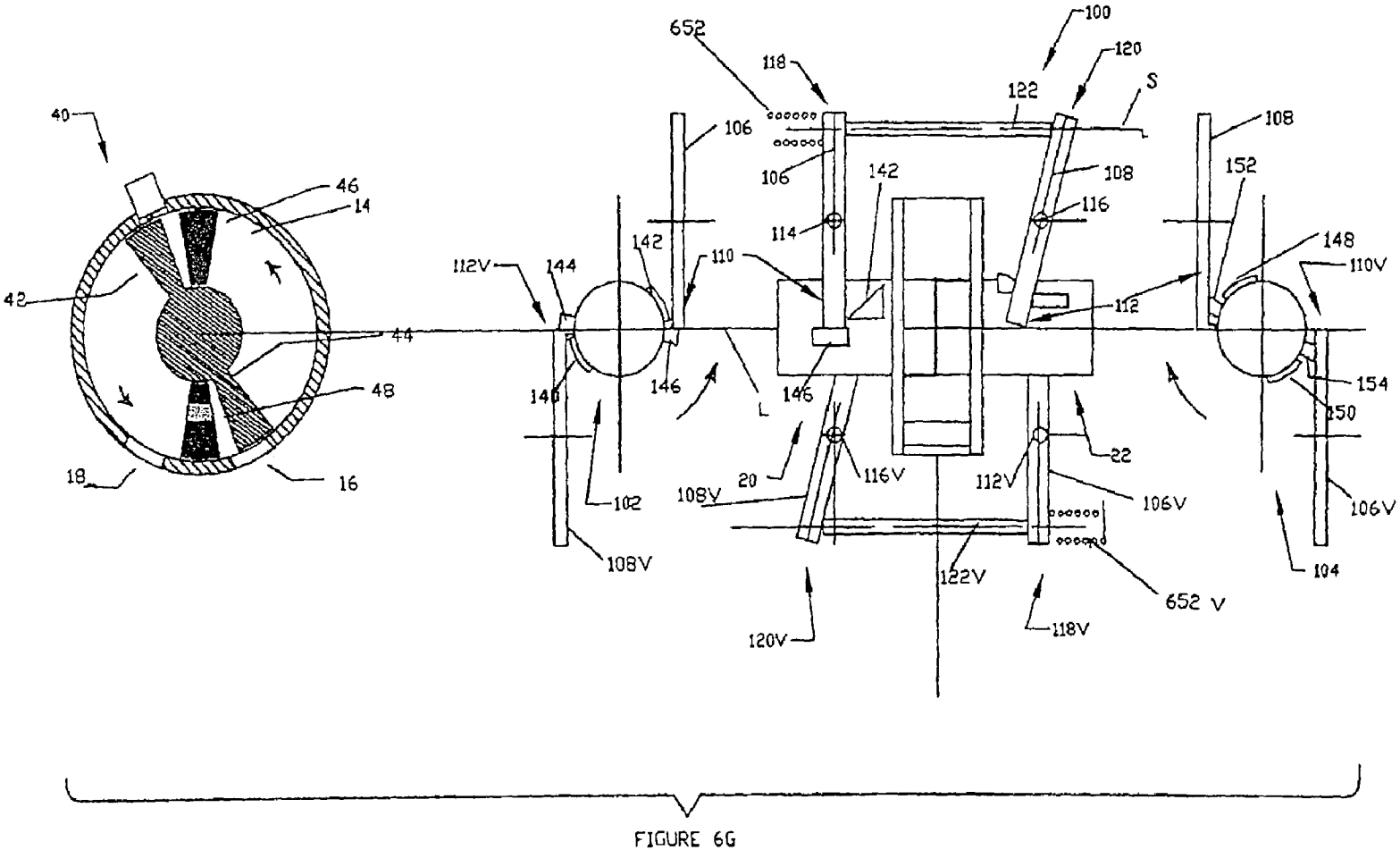

The first pair of stop blocks 144, 146 are adapted to selectively engage the first end 110 of the first pivotable member 106 when the first pivotable member is in a first position shown in FIGS. 6*a*, 6*b* and 6*g*. When the first end of the first pivotable member is engaged with either one of the first pair of stop blocks, the rotation of the first piston assembly 20 is stopped.

Similar to the above, the second pair of stop blocks 152, 154 are adapted to selectively engage the first end 110V of the fourth pivotable member 106V when the fourth pivotable member is in a first position shown in FIGS. 6*d* and 6*e*. When the first end of the fourth pivotable member is engaged with either one of the second pair of stop blocks, the rotation of the second piston assembly 22 is prevented.

The first pair of ramp surfaces 140, 142 disposed on the first piston assembly are adapted to engage the first end 112V of the second pivotable member 108V when the second pivotable member is in a second position opposite the first position as shown best in FIGS. 6*d*, 6*e*, and 6*f*. When the first end of the second pivotable member engages either one of the ramp surfaces provided on the rotating first piston assembly 20, the second pivotable member is urged from the second position shown in FIGS. 6*d,* 6*e*, and 6*f* into the first position shown in FIGS. 6*a,* 6*b*, and 6*g*. As the second pivotable member is moved from the second position to the first position, the fourth pivotable member is moved as well through the linear motion of the slidable member 122V. More particularly, as the second pivotable member moves from the second position to the first position, the fourth pivotable member moves from its first position shown in FIGS. 6*d* and 6*e* into its second position shown in FIGS. 6*a,* 6*b*, and 6*g*.

The second pair of ramp surfaces 148, 150 provided on the second rotating piston assembly 22 are adapted to engage the first end 112 of the third pivotable member 108 when the third pivotable member is in a second position opposite the first position as shown best in FIGS. 6*a,* 6*b*, and 6*g*. As the first end of the third pivotable member engages either of the second pair of ramp surfaces, the third pivotable member is urged from the second position to the first position shown in FIGS. 6*d* and 6*e*. Simultaneous with the movement of the third pivotable member from the second position to the first position, the first pivotable member moves to its second position shown best in FIGS. 6*d* and 6*e*.

When the first end of the first pivotal member 110 is caused to move from the stop block 144 or 146, piston assembly 20 will move stop blocks 144 and 146 to a position that permits spring 652 to move the first pivotal member to position 1. This spring produced motion occurred between FIGS. 6*c* and 6*d*.

When the first end of the first pivotal member 110V is caused to move from the stop block 152 or 154, piston assembly 22 will move from stop blocks 152, 154 to a position that permits spring 652V to move the first pivotal member to position 1. This spring produced motion occurred between FIGS. 6*f* and 6*g*.

The Table I below summarizes the sequencing of the preferred braking mechanism 100 of the present invention described above and illustrated in FIGS. 6*a*–6*g*.

TABLE I

| FIGURE | FIRST PISTON ASSEMBLY | SECOND PISTON ASSEMBLY | FIRST PIVOTABLE MEMBER | SECOND PIVOTABLE MEMBER | THIRD PIVOTABLE MEMBER | FOURTH PIVOTABLE MEMBER |
|---|---|---|---|---|---|---|
| 6a | Locked | Free | First Position | Second Position | Second Position | First Position |
| 6b | Locked | Free | First Position | Second Position | Second Position | First Position |
| 6c | Locked | Free | Sliding OFF Stop Block | Second Position | Sliding ON Ramp | First Position |
| 6d | Free | Locked | First Position | Second Position | Second Position | First Position |
| 6e | Free | Locked | First Position | Second Position | Second Position | First Position |
| 6f | Free | Locked | First Position | Sliding ON Ramp | Second Position | Sliding OFF Block |
| 6g | Locked | Free | First Position | Second Position | Second Position | First Position |

Figure 7:
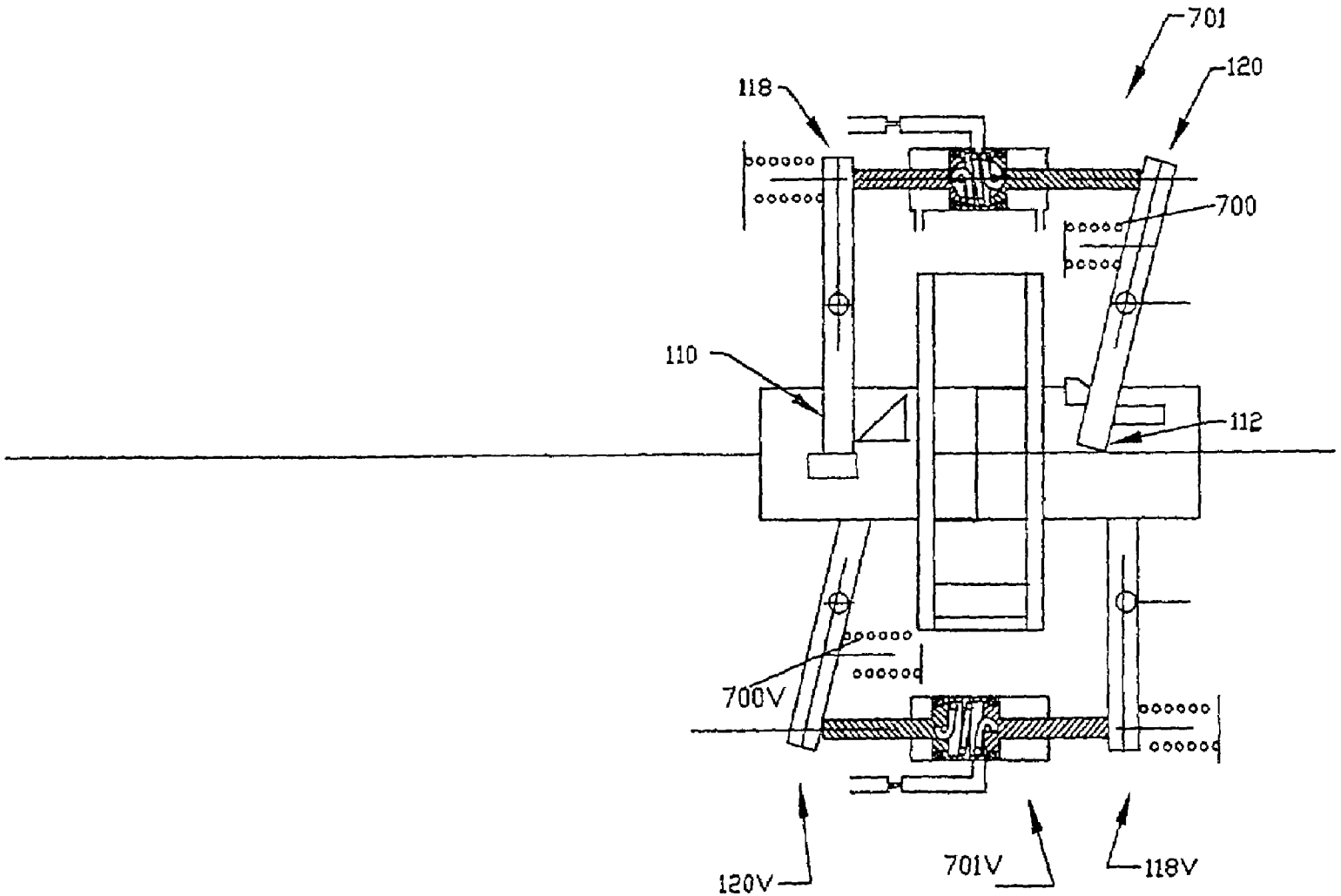
FIG. 7 illustrates a preferred mechanism for controlling piston assembly motion while allowing for adjustment of the internal compression ratio.
Figure 8:
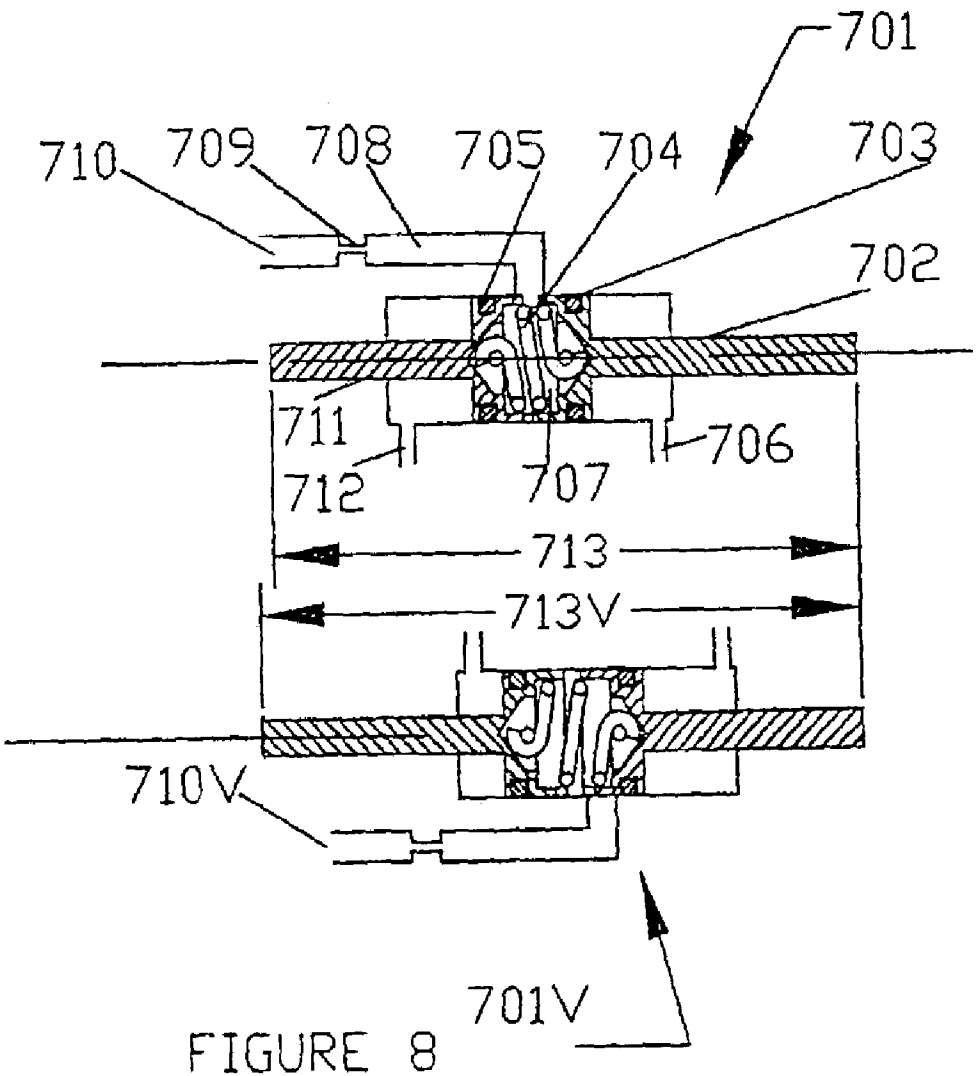
FIG. 8 illustrates a detailed view of the hydromechanical device controlling the adjustment of the compression ratio.

FIGS. 7 and 8 illustrate the subject expansible chamber device used as an expansible chamber device with a variable compression ratio. FIG. 7 shows the general specification while FIG. 8 provides a detailed view of the compression ratio control device. Referring now to FIG. 7 elongate members 106, 106*v*, 108, and 108*v* are shown in the same position as FIG. 6*a* as explained above and with reference to Table I. Springs 652, and 700*v* hold elongate members 106 and 108*v*, respectively, in contact with stop blocks 144 and 146 (not shown), thereby placing the first piston assembly in a locked position. Alternately springs 700 and 652V hold elongate members 106V and 108, respectively, in contact with stop blocks 152 and 154 (not shown),thereby placing the second piston assembly in a locked position. Elongated members 106, 108, 106*v*, and 108*v* are connected by slidable member adjustment units 701, 701*v* respectively.

It is to be appreciated that the spring 700 urges member 108 to the right as shown in the Figure during times when the lower end of member 106 is constrained from pivoting by the position of stop block 146. The spring 700 urges member 108 to rotate off of member 122 and into proper position relative to ramps 148, 150 and stop blocks 150, 152 even though member 106 may be constrained from pivoting. Spring 700V performs an equivalent function with members 106V, and 108V.

Referring now to FIG. 8, slidable member adjustment unit 701 is shown in detail. The length of slidable member is controlled by member adjustment unit 701. Two slidable piston assemblies, 702, 711, are connected by a retention spring 704, with the leading ends enclosed in the bore of the adjustment unit 701 and the trailing ends attached to elongated members 106, 108 respectively. The piston assemblies leading ends are moveable within the bore and relative to each other along a concentric axis.

The area between the two pistons defines a chamber 707. Pistons 702, 711 maintain pressure in the chamber 707 via seals 703, 705 respectively. Fluid enters the chamber 707 via a first conduit 708. The first conduit 708 is fed via second conduit 710, connected to the first conduit 708 by a flow restrictor 709. Pressure vents 706, 712 are located within the bore of the member adjustment unit at the trailing end of pistons 702, 711 respectively.

Referring still to FIG. 8, when the system is at rest, the length of the entire slidable member is indicated by distance 713. The fluid pressure in chamber 707 and first conduit 708 are equal. The pressure in first conduit 708 is determined by the pressure in second conduit 710 and the physical constraints of the flow restrictor 709. In order to adjust the length of the slidable member, fluid pressure in increased in the second conduit 710 via an external source. When the pressure in chamber 707 is increased beyond the force exerted by the retention spring 704, the pistons will push apart, thus lengthening the slidable member unit to the new distance of 713*v*. The increase in the length of the slidable member unit will cause the timing of the engagement of the stop block to change, thereby reducing the compression ratio within the expansible chamber device.

The previously described means for synchronizing the motion of the two motor piston assemblies can be used in all applications of the motor. Another simpler synchronization means can be used when the output shaft rotates continuously. Several means for obtaining such continuous motion have been described. FIG. 20 of U.S. Pat. No 6,036,461, for instance shows how a differential mechanism can be used to produce such continuous rotation. Exploitation of this characteristic results in a control mechanism simpler than that illustrated in FIGS. 6*a* through 6*g*, 7 or 8. A description of a mechanical means for controlling piston assembly motion by the use of the output shaft follows.

Figure 9:
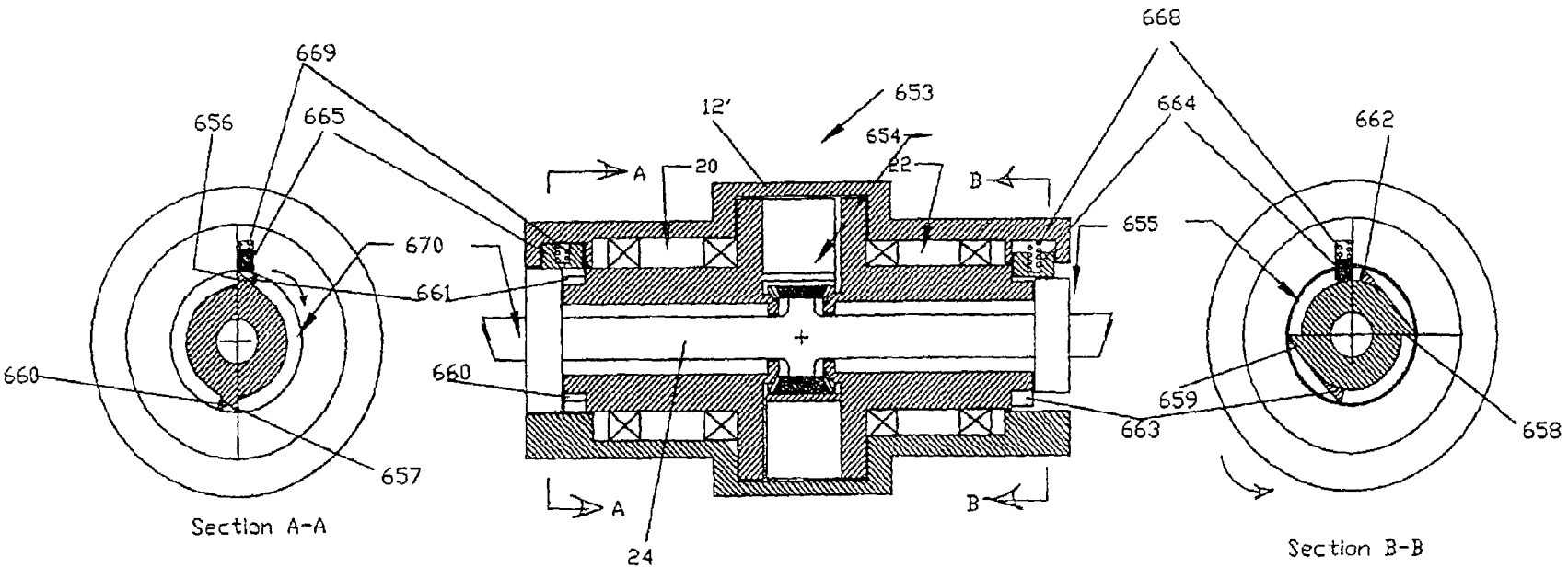
FIG. 9 illustrates a preferred mechanism for controlling piston assembly motion by the use of the output shaft of the subject expansible chamber; and, FIG. 10 is a schematic illustration of system for controlling fuel injection/ignition in an expansible chamber device in accordance with another embodiment of the invention.

FIG. 9 illustrates an arrangement which controls a motor as described in FIG. 2. This design has two piston assemblies 22, 20. Each piston assembly has one pair of interdigitated vanes. The first and second piston assemblies are rotatably movable in a cylindrical chamber. Piston assemblies 22, 20 each have two stopping surfaces 662, 663, and 661, 662, respectively. The motor housing 12' has two movable reaction members 664, 665 that can move in position to contact a stopping surface 662, 663, 660, or 661, thus impeding piston assembly ( 22 or 20 ) rotation. Springs 668, 669 urge the reaction members 664, 665, respectively to a location where they would impede piston assembly motion after contact with a stopping surface 662, 663, 660, or 661. Output shaft 24 rotation is produced by mechanism 654 and piston assemblies 22 and 20. Shaft 24 has two cam assemblies 655, 670 which have cams 658, 659 and 656, 657, respectively. Cams 658, 659 and 656, 657 will act on reaction members 664, 667, respectively when it is appropriate for stopped piston assembly 22 or 20 be released.

Consider sequence actions for the implementation shown in FIG. 9. At the time prior to that shown in FIG. 9, piston assembly 20 was held stationary by reaction member 665 (spring 669 was extended and had moved reaction member 665 to blocking position). The rotating shaft 24 was causing cam 656 to approach reaction member 662 to approach reaction member 664.

At the instant shown in FIG. 9, piston assembly 20 had just been released by reaction member 665 (cam 656 had lifted reaction member 665 and compressed spring 669 ). The rotating shaft 24 is causing stopping surface 662 to approach reaction member 664.

After shaft 24 rotates approximately an additional 90 degrees, cam 658 would have caused reaction member 664 to lift and release stopping surface 662 (thus allowing piston assembly 22 to move). Stopping surface 660 will be stopped by reaction member 665 (thus stopping piston assembly 20 ).

After shaft 24 rotates approximately 90 degrees ( 180 degrees from its position in FIG. 50) cam 657 will lift reaction member 665, thus releasing piston assembly 20. Stopping surface 663 will impact reaction member 664, thus stopping piston assembly 22.

After shaft 24 rotates another 90 degrees ( 270 degrees from its position in FIG. 50) cam 659 will lift impact reaction member 664, thus releasing piston assembly 22. Stopping surface 661 will impact reaction member 665, thus stopping piston assembly 20.

After shaft 24 rotates another 90 degrees, shaft 24 will have completed one complete revolution, piston assembly 20 will be starting to move and piston assembly 22 will be stopping. This cycle repeats as long as forces are acting which urge the piston assemblies 22, 20 to rotate.

Figure 10:
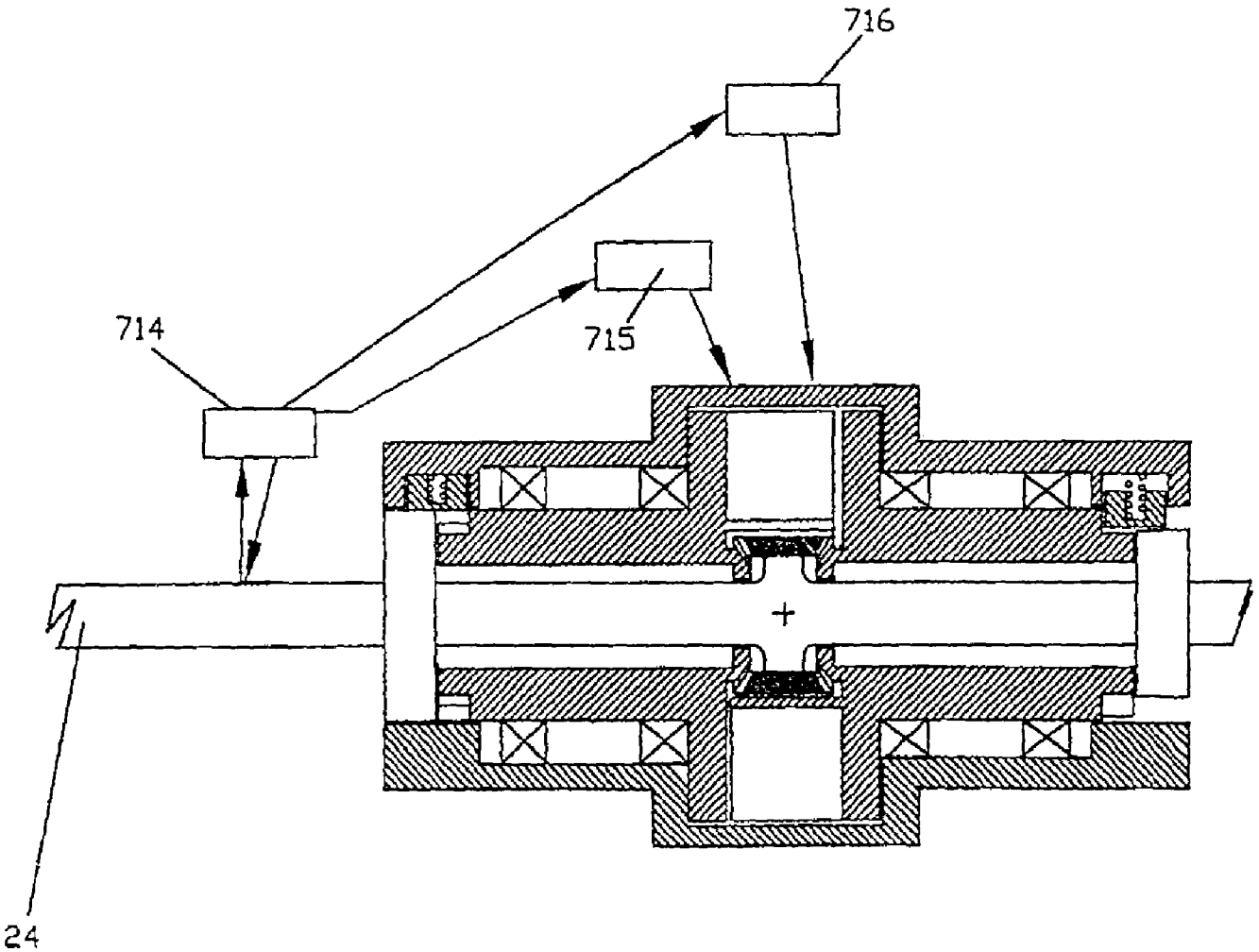

With reference next to FIG. 10, another embodiment of the present invention provides control of fuel injection and/or fuel ignition by sensing the angular position of each piston within the internal combustion engine. It is to be appreciated that the position of the first piston 20 relative to the second piston 22 is used to determine the proper instant of fuel injection and/or fuel ignition. When the relative positions of the pistons 20, 22 and the output shaft 24 are controlled such as, for example, using a differential gear set, then the output shaft 24 directly indicates the proper instant for fuel injection and/or the proper instant for fuel ignition.

In this embodiment of the invention, a control system for fuel injection and fuel ignition is provided. A suitable position sensor 714 is operatively coupled with the output shaft 24 for determining the position of piston 20 relative to piston. 22. This measurement is in turn sent to a fuel injection device 715 and a fuel ignition and ignition system 716. Through use of the system illustrated in FIG. 10, the starting, stopping, and rotation rate of the motor are controlled.

The invention has been described with reference to the preferred embodiments. Obviously, modifications and alterations will occur to others upon a reading and understanding of this specification. It is intended to include all such modifications and alterations insofar as they come within the scope of the above specification and descriptions.

The invention claimed is:

1. An internal combustion engine comprising:

a housing defining a cylindrical working chamber having inlet ports and exhaust ports;

first and second interdigitated piston assemblies rotatably movable in said cylindrical working chamber, each of the piston assemblies including at least one pair of diametrically opposed radial vanes forming pistons in the working chamber and dividing the working chamber into a plurality of pairs of diametrically opposed compartments; and, a braking mechanism for controlling the motion of the piston assemblies to cause intermittent rotation of the first and second piston assemblies in the same direction during recurrent periods of rotation with each of said first and second piston assemblies being stopped between said periods of rotation, the braking mechanism including a first and second set of cam surfaces on the first and second piston assemblies respectively, a set of movable members adapted to alternately move between first and second positions, in said first position the set of movable members engaging the first set of cam surfaces to stop the rotation of the first piston assembly while permitting the second piston assembly to rotate freely and in said second position the set of movable members engaging the second set of cam surfaces to stop the rotation of the second piston assembly while permitting the first piston assembly to rotate freely, said set of movable members being biased to return to a one of the first and second positions to prevent said set of movable members from contacting both said first and second set of cam surfaces while the piston assemblies are stopped.

2. The internal combustion engine according to claim 1, further including a resilient member biasing the set of movable members to said one of the first and second positions.

3. The internal combustion engine according to claim 2, wherein the resilient member is a spring.

4. The internal combustion engine according to claim 1, wherein said braking mechanism includes:

a first reaction member operatively coupled with said housing, the first reaction member being adapted to engage said first set of cam surfaces on the first piston assembly; and, a second reaction member operatively coupled with said housing, the second reaction member being adapted to engage said second set of cam surfaces on the second piston assembly.

5. The internal combustion engine according to claim 4, wherein:

the first reaction member is biased into contact with said first set of cam surfaces on the first piston assembly; and, the second reaction member is biased into contact with said second set of cam surfaces on the second piston assembly.

6. The internal combustion engine according to claim 5, wherein:

the first reaction member is a first pivotable member biased by a first spring into contact with said first set of cam surfaces; and, the second reaction member is a second pivotable member biased by a second spring into contact with said second set of cam surfaces.

7. The internal combustion engine according to claim 1, wherein said braking mechanism includes:

a first elongate pivotable member having first and second ends, the first end of the first pivotable member being adapted to engage said first set of cam surfaces on the first piston assembly;

a second elongate pivotable member having first and second ends, the first end of the second pivotable member being adapted to engage said second set of cam surfaces on the second piston assembly; and, a slidable member disposed between the first pivotable member and the second pivotable member for transmitting motion between the second end of the first pivotable member and the second end of the second pivotable member, said slidable member being adjustable in length thereby modifying a compression ratio of the internal combustion engine.

8. The internal combustion engine according to claim 7, wherein said slidable member is adjustable in length during operation of said internal combustion engine.

9. The internal combustion engine according to claim 7, wherein:

said first set of cam surfaces on the first piston assembly include a first pair of ramp surfaces and a first pair of stop blocks; and, said second set of cam surfaces on the second piston assembly include a second pair of ramp surfaces and a second pair of stop blocks.

10. The internal combustion engine according to claim 9, wherein:

said first pair of stop blocks are adapted to selectively engage the first end of the first pivotable member when the first pivotable member is in a first position and stop said rotation of the first piston assembly when the first end of the first pivotable member is engaged with a one of said first pair of stop blocks; and, said second pair of stop blocks are adapted to selectively engage the first end of the second pivotable member when the second pivotable member is in a first position and stop said rotation of the second piston assembly when the first end of the second pivotable member is engaged with a one of said second pair of stop blocks.

11. The internal combustion engine according to claim 10, wherein:

the first pair of ramp surfaces are adapted to engage the first end of the first pivotable member when the first pivotable member is in a second position opposite said first position and simultaneously urge i) the first pivotable member from said second position to said first position; and, ii) together with said slidable member, said second pivotable member into said second position; and, the second pair of ramp surfaces are adapted to engage the first end of the second pivotable member when the second pivotable member is in a second position opposite said first position and simultaneously urge i) the second pivotable member from said second position to said first position; and, ii) together with said slidable member, said first pivotable member into said second position.

12. The internal combustion engine according to claim 11, wherein the slidable member includes first and second rod members extending between the second end of the first pivotable member and the second end of the second pivotable member, the first and second rod members carrying piston assemblies connected together by a retention spring member.

13. The slidable member of claim 12, wherein said slidable member includes a spring encased in a housing to permit relative slidable motion between the first and second rod members.

14. The internal combustion engine according to claim 13, wherein:

said first pair of ramp surfaces are formed on opposite sides of said first piston assembly;

said first pair of stop blocks are formed on opposite sides of said first piston assembly;

said second pair of ramp surfaces are formed on opposite sides of said second piston assembly; and, said second pair of stop blocks are formed on opposite sides of said second piston assembly.

15. An expansible chamber apparatus comprising:

a housing defining a cylindrical working chamber having inlet ports and exhaust ports;

first and second interdigitated piston assemblies rotatably movable in said cylindrical working chamber, each of the piston assemblies including at least one radial vane forming pistons in the working chamber and dividing the working chamber into at least one pair of diametrically opposed compartments; and, a braking mechanism for controlling the motion of the piston assemblies to cause intermittent rotation of the first and second piston assemblies in the same first direction during recurrent periods of rotation with each of said first and second piston assemblies being stopped between said periods of rotation, the braking mechanism including a set of movable members adapted to alternately move between first and second positions, in said first position the set of movable members preventing rotation of the first piston assembly in said first direction while permitting the second piston assembly to rotate freely and in said second position the set of movable members preventing rotation of the second piston assembly in said first direction while permitting the first piston assembly to rotate freely, the set of movable members being biased to a one of said first and second positions to permit rotation of at least one of said first and second piston assemblies when starting the expansible chamber device from a rest or stopped condition.

16. An expansible chamber apparatus comprising:

a housing defining a cylindrical working chamber having inlet ports and exhaust ports;

first and second interdigitated piston assemblies rotatably movable in said cylindrical working chamber, each of the piston assemblies including at least one radial vane forming pistons in the working chamber and dividing the working chamber into at least one pair of diametrically opposed compartments; and, a braking mechanism for controlling the motion of the piston assemblies to cause intermittent rotation of the first and second piston assemblies in the same direction during recurrent periods of rotation with each of said first and second piston assemblies being stopped between said periods of rotation, the braking mechanism including a set of movable members adapted to alternately stop the rotation of the first piston assembly relative to said housing while permitting the second piston assembly to rotate freely and then stop the rotation of the second piston assembly relative to said housing while permitting the first piston assembly to rotate freely, the set of movable members being adjustable to control a compression ratio in said expansible chamber apparatus.

17. The expansible chamber apparatus according to claim 16, wherein the set of movable members are adjustable during operation of the apparatus.

18. An expansible chamber apparatus comprising:

a housing defining a cylindrical working chamber having inlet ports and exhaust ports;

first and second interdigitated piston assemblies rotatably movable in said cylindrical working chamber, each of the piston assemblies including at least one radial vane forming pistons in the working chamber and dividing the working chamber into at least one pair of diametrically opposed compartments; and, a braking mechanism for controlling the motion of the piston assemblies to cause intermittent rotation of the first and second piston assemblies in the same direction during recurrent periods of rotation with each of said first and second piston assemblies being stopped between said periods of rotation, the braking mechanism including a set of movable members adapted to alternately move between first and second positions, in said first position the set of movable members preventing rotation of the first piston assembly while permitting the second piston assembly to rotate freely and in said second position the set of movable members preventing rotation of the second piston assembly while permitting the first piston assembly to rotate freely, the set of movable members being biased to a one of said first and second positions to permit rotation of at least one of said first and second piston assemblies when starting the expansible chamber device from a rest or stopped condition, the set of movable members further being adjustable to control a compression ratio in said expansible chamber apparatus.

19. In an expansible chamber apparatus including a housing defining a cylindrical working chamber having inlet ports and exhaust ports, and first and second interdigitated piston assemblies rotatably movable in said cylindrical working chamber, each of the piston assemblies including at least one radial vane forming pistons in the working chamber and dividing the working chamber into at least one pair of diametrically opposed compartments, a mechanism for controlling the motion of the piston assemblies to cause intermittent rotation of the first and second piston assemblies in the same direction during recurrent periods of rotation with each of said first and second piston assemblies being stopped between said periods of rotation, the mechanism comprising:

a set of movable members adapted to alternately move between first and second positions, in said first and second positions, in said first position the set of movable members preventing rotation of the first piston assembly while permitting the second piston assembly to rotate freely and in said second position the set of movable members preventing rotation of the second piston assembly while permitting the first piston assembly to rotate freely, the set of movable members being biased to a one of said first and second positions to permit rotation of at least one of said first and second piston assemblies when starting the expansible chamber device from a rest or stopped condition.

20. In an expansible chamber apparatus including a housing defining a cylindrical working chamber having inlet ports and exhaust ports, and first and second interdigitated piston assemblies rotatably movable in said cylindrical working chamber, each of the piston assemblies including at least one radial vane forming pistons in the working chamber and dividing the working chamber into at least one pair of diametrically opposed compartments, a mechanism for controlling the motion of the piston assemblies to cause intermittent rotation of the first and second piston assemblies in the same direction during recurrent periods of rotation with each of said first and second piston assemblies being stopped between said periods of rotation, the mechanism comprising:

a set of movable member adapted to alternately stop the rotation of the first piston assembly while permitting the second piston assembly to rotate freely and then stop the rotation of the second piston assembly while permitting the first piston assembly to rotate freely, the set of movable members being adjustable to control a compression ratio in said expansible chamber apparatus.

21. The mechanism according to claim 20, wherein the set of movable members are adjustable during operation of the apparatus.

22. In an expansible chamber apparatus including a housing defining a cylindrical working chamber having inlet ports and exhaust ports, first and second interdigitated piston assemblies rotatably movable in said cylindrical working chamber, each of the piston assemblies including at least one radial vane forming pistons in the working chamber and dividing the working chamber into at least one pair of diametrically opposed compartments, a mechanism for controlling the motion of the piston assemblies to cause intermittent rotation of the first and second piston assemblies in the same direction during recurrent periods of rotation with each of said first and second piston assemblies being stopped between said periods of rotation, the mechanism comprising:

a set of movable members adapted to alternately stop the rotation of the first piston assembly while permitting the second piston assembly to rotate freely and then stop the rotation of the second piston assembly while permitting the first piston assembly to rotate freely, the set of movable members being adjustable to control a compression ratio in said expansible chamber apparatus.

* * * * *